US006675731B2

(12) United States Patent
Dhellemmes

(10) Patent No.: US 6,675,731 B2
(45) Date of Patent: Jan. 13, 2004

(54) WATERTIGHT AND THERMALLY INSULATING TANK WITH OBLIQUE LONGITUDINAL SOLID ANGLES OF INTERSECTION

(75) Inventor: Jacques Dhellemmes, Versailles (FR)

(73) Assignee: Gaz Transport & Technigaz, Trappes (FR)

( * ) Notice: Subject to any disclaimer, the term of this patent is extended or adjusted under 35 U.S.C. 154(b) by 0 days.

(21) Appl. No.: 10/184,981

(22) Filed: Jul. 1, 2002

(65) Prior Publication Data

US 2003/0000949 A1 Jan. 2, 2003

(30) Foreign Application Priority Data

Jun. 29, 2001 (FR) ..... 01 08592

(51) Int. Cl.[7] ..... B63B 25/16

(52) U.S. Cl. ..... 114/74 A; 220/560.07; 220/560.11; 220/560.12; 220/560.15; 220/901

(58) Field of Search ..... 114/74 A; 220/560.07, 220/560.11, 560.12, 560.15, 560.04, 901

(56) References Cited

U.S. PATENT DOCUMENTS 3,842,775 A * 10/1974 Edwards et al. ..... 114/74 R
4,095,546 A * 6/1978 Kane ..... 114/74 R
4,155,482 A 5/1979 Swaney
4,230,061 A * 10/1980 Roberts et al. ..... 114/74 A
5,450,806 A 9/1995 Jean
6,145,690 A 11/2000 Dhellemmes et al.
2002/0023926 A1 2/2002 Dhellemmes

FOREIGN PATENT DOCUMENTS

FR 2 724 623 3/1996

* cited by examiner

*Primary Examiner*—Sherman Basinger
(74) *Attorney, Agent, or Firm*—Young & Thompson

(57) ABSTRACT

A watertight and thermally insulating tank built into a bearing structure includes at least one wall having a variable width and forming oblique solid angles of intersection with the adjacent walls, the tank includes secondary insulating and watertightness barriers and a primary insulating barrier which are formed by panels fixed to the walls and able to hold a primary watertightness barrier. The primary watertightness barrier includes, at each variable-width wall, one or more central strake(s) (63) arranged longitudinally and each fixed to underlying panels (12), running strakes (66) being held mechanically, by a sliding joint, parallel to the oblique solid angles of intersection, on underlying panels and fixed at the ends to the central strakes, so that the tensile forces (F) experienced by the running strakes in their longitudinal dimension are transmitted to the bearing structure via the central strakes.

19 Claims, 4 Drawing Sheets

WATERTIGHT AND THERMALLY INSULATING TANK WITH OBLIQUE LONGITUDINAL SOLID ANGLES OF INTERSECTION

BACKGROUND OF THE INVENTION

The present invention relates to a watertight and thermally insulating tank, particularly for storing liquefied gases, such as liquefied natural gases with high methane content, at a temperature of about −160° C., the said tank being built into a bearing structure of a ship, particularly the hull of a ship intended for transporting liquefied gases by sea.

The present invention relates more particularly to a watertight and thermally insulating tank built into a bearing structure of a ship, the said bearing structure being of polygonal cross section and comprising a number of practically flat rigid walls adjacent via their longitudinal edges, at least one of the said walls having a variable width over at least part of the length of the wall, the solid angles of intersection of the bearing structure which are formed by the said variable-width wall and the adjacent walls being orientated obliquely.

DESCRIPTION OF THE RELATED ART

A tank comprising two successive watertightness barriers, one of them a primary barrier in contact with the product contained in the tank and the other a secondary barrier arranged between the primary barrier and the bearing structure, these two watertightness barriers alternating with two thermally insulating barriers, a primary one and a secondary one respectively, is known, particularly from French Patent Application 2 724 623.

In the aforementioned application, the secondary barriers and the primary insulating barrier essentially consist of a collection of practically parallelepipedal prefabricated panels fixed mechanically to the walls of the bearing structure, each panel being formed, firstly, of a first rigid plate carrying a layer of thermal insulation and with it constituting a secondary insulating barrier element, secondly, of a flexible sheet adhering to practically the entire surface of the layer of thermal insulation of the aforementioned insulating barrier element, the said sheet comprising at least one continuous thin metal foil forming a secondary watertightness barrier element, thirdly, of a second layer of thermal insulation adhering to the aforementioned sheet, of a second rigid plate covering the second layer of thermal insulation and with it constituting a primary insulating barrier element. The primary watertightness barrier consists of metal strakes, for example made of Invar, held mechanically so as to slide on the rigid plate of the primary insulating barrier by their turned-up longitudinal edges.

Each prefabricated panel has the overall shape of a rectangular parallelepiped, the secondary insulating barrier element and the primary insulating barrier element having, respectively, viewed in plan view, the shape of a first rectangle and of a second rectangle, the sides of which are practically parallel, the length and/or width of the second rectangle being shorter than that (those) of the first rectangle so as to form a peripheral rim.

The peripheral rims of adjacent panels and the lateral walls of the primary insulating barrier elements define joining regions which are filled with insulating tiles each consisting of a layer of thermal insulation, covered by a rigid plate, the rigid plates of the insulating tiles and the second rigid plates of the panels constituting a practically continuous wall able to support the primary watertightness barrier, the regions where the secondary insulating barrier elements meet being filled with connectors made of insulating material. To ensure the continuity of the watertightness of the secondary watertightness barrier at the join between two panels, the rims are, before the joining tiles are fitted, covered with a band of flexible sheet comprising at least a continuous thin metal foil, the said band adhering to the adjacent lateral rims.

It is known that the cooling of the tank generates, at the primary and secondary watertightness barriers, tensile stresses which add to the tensile stresses generated in these watertightness barriers by the deformation of the beam that constitutes the ship when the ship is moving in the swell. When practically flat Invar-plate strakes are used, the movements of thermal contraction are of limited amplitude, but nonetheless remain. In a known way, the metal strakes, slideably mounted on the prefabricated panels, are fixed at their ends to the bearing structure of the ship by a rigid corner structure such as those described in French Patents 2 709 725 and 2 780 942, so that tensile forces in the longitudinal direction of the strakes are transmitted to the bearing structure.

The bearing structure to which the panels are fixed is formed from the walls of the double hull of the ship. The walls of the double hull form compartments each defined by a number of practically flat longitudinal walls adjacent by their longitudinal edges and having a polygonal cross section in the shape of a polyhedron, particularly an irregular octahedron, the angles at the solid angles of intersection of two adjacent longitudinal walls of which generally measure 90° or 135°, and two transverse partitions at the longitudinal ends of the compartment, parallel to one another and perpendicular to the longitudinal walls. The longitudinal walls and the transverse partitions of a compartment constitute the bearing structure of the tank. In general, the longitudinal walls are arranged more or less in a cone with a polygonal directrix curve, in the bow part of the said ship and also in its stern part, and as a cylinder with a polygonal directrix curve in the remainder of the ship.

To produce a tank built into a compartment of constant cross section, comprising only rectangular longitudinal walls, the prefabricated panels are arranged side by side parallel to the axis of the tank, and the strakes are arranged longitudinally on the panels. In the case of a tank intended to be built into the front of the ship, the compartment generally has at least one bottom wall and a roof wall of trapezoidal shape, the cross section of which decreases towards the front of the ship. On these walls of trapezoidal shape, the prefabricated panels are also arranged parallel to the axis of the tank and cut to suit the oblique solid angles of intersection, the strakes being held parallel to the longitudinal axis and cut obliquely at the ends to tailor them to the oblique solid angles of intersection. The end of each strake is fixed at an angle to a vertical pillar, itself fixed to the bearing structure at the oblique solid angle of intersection. To allow this fixing, the pillar is formed of two stainless steel posts welded one on each side of an Invar mounting plate to which the strake is welded, the secondary watertightness barrier also being fixed to the said mounting plate.

A fixing such as this establishes a direct thermal bridge between the primary barrier and the bearing structure, and this is prejudicial in terms of insulating performance. Furthermore, such a structure has numerous disadvantages. Producing the pillars entails heterogeneous welding which is tricky to implement. Access to the pillars is relatively difficult and makes the operation of welding the strakes to the mounting plate painstaking. The size of the pillars makes filling the corner structures at the solid angles of intersection with insulating tiles more difficult. In addition, the pillars have a tendency to twist because the strakes are fixed to them at an angle.

SUMMARY OF THE INVENTION

The object of the invention is to propose a tank built into a bearing structure with obliquely orientated solid angles of intersection which make it possible to alleviate the aforementioned drawbacks.

To achieve this, the present invention proposes a watertight and thermally insulating tank built into a bearing structure particularly of a ship, the said bearing structure being of polygonal cross section and comprising a number of practically flat rigid walls adjacent by their longitudinal edges, at least one of the said walls having a width that varies over at least part of the length of the wall, the solid angles of intersection of the bearing structure which are formed by the said variable-width wall and the adjacent walls being orientated obliquely, the said tank comprising two successive watertightness barriers, one of them a primary watertightness barrier in contact with the product contained in the tank and the other a secondary watertightness barrier arranged between the said primary watertightness barrier and the bearing structure, a primary thermally insulating barrier being arranged between these two watertightness barriers and a secondary thermally insulating barrier being arranged between the said secondary watertightness barrier and the bearing structure, the secondary insulating and watertightness barriers and the primary insulating barrier being essentially formed of a collection of juxtaposed panels fixed to the walls of the bearing structure over practically its entire interior surface, the said panels being able to support and to hold the primary watertightness barrier, the said primary watertightness barrier comprising practically flat running metal strakes, made of thin plate with a low coefficient of expansion, the longitudinal edges of which are turned up towards the inside of the tank, each running strake being assembled in a watertight manner with at least one longitudinally adjacent running strake, the adjacent turned-up edges of the said running strakes being welded to the two faces of a weld support, which is held mechanically on panels and constitutes a sliding joint, characterized in that the said primary watertightness barrier further comprises, at each variable-width wall, one or more practically flat central strake(s) made of thin plate with a low coefficient of expansion, which is (are) arranged longitudinally and each of which is fixed to underlying panels, running strakes being held, parallel to the oblique solid angles of intersection of the variable-width wall, on underlying panels and fixed in a watertight manner at the ends to the central strake(s), so that the tensile forces experienced by the running strakes in their longitudinal dimension, generated by the thermal contraction and/or the static or dynamic pressure of the product contained in the said tank, are transmitted at least in part to the bearing structure via the central strake(s).

According to one embodiment, the variable-width wall has a plane of symmetry passing through the longitudinal axis of the said wall and perpendicular to the flat surface of the said wall.

In particular, the variable-width wall has a width which varies monotonously along the entire length of the said wall.

According to one particular feature, one or more end central strakes are fixed to the bearing structure by rigid corner structures.

According to one embodiment, the aforementioned panels comprise central panels juxtaposed longitudinally along the said plane of symmetry of the variable-width wall, forming at least one row, to which the central strake(s) are fixed, so that the transverse components of the said tensile forces experienced by the running strakes in their longitudinal dimension at least partially cancel each other out, and lateral panels arranged on each side of the central panels on which running strakes are held.

According to another particular feature, the tank comprises several central strakes, the adjacent transverse edges of the said central strakes being welded to weld supports which are held mechanically on the central panels.

According to one embodiment, the said central panels are formed, firstly, of a first rigid plate carrying a layer of thermal insulation and with it constituting a secondary insulating barrier element, secondly, of a sheet adhering to practically the entire area of the layer of thermal insulation of the aforementioned secondary insulating barrier element, the said sheet comprising at least one continuous metal foil forming a secondary watertightness barrier element, thirdly, of a second layer of thermal insulation covered by a second rigid plate and by a rigid layer which are juxtaposed, the said rigid layer and the said second layer of thermal insulation which at least partially cover the aforementioned sheet and which adhere thereto constituting a primary insulating barrier element, the said central panels being arranged in such a way that the second layers of thermal insulation and the rigid layers alternate longitudinally, the central strake(s) being at least fixed to the rigid layers of the central panels.

Advantageously, the weld support associated with two adjacent central metal strakes is held mechanically on the rigid layer of a central panel and is a section piece with a bracket-shaped cross section, one of the flanges of the bracket being fixed against the lateral face of the rigid layer facing the second layer of insulation of the central panel, while the other flange is fixed by one of its faces against the top face of the solid layer and welded by its other face to the adjacent transverse edges of the two central strakes.

According to a particular feature, the ends of the running strakes partially cover the central strake(s) and have an oblique edge practically parallel to the plane of symmetry, along which they are welded to the central strake(s).

According to one embodiment, each central panel has the overall shape of a rectangular parallelepiped, the secondary insulating barrier element and the primary insulating barrier element having, respectively, viewed in plan view, the shape of a first rectangle and of a second rectangle, the sides of which are practically parallel, the length and/or width of the first rectangle being shorter than that (those) of the second rectangle so as to form a peripheral lateral rim, preferably of constant width.

According to one embodiment, the lateral panels are formed, firstly, of a first rigid plate carrying a layer of thermal insulation and with it constituting a secondary insulating barrier element, secondly, of a flexible sheet adhering to practically the entire surface of the layer of thermal insulation of the aforementioned secondary insulating barrier element, the said sheet comprising at least one continuous thin metal foil forming a secondary watertightness barrier element, thirdly, of a second layer of thermal insulation which at least partially covers the aforementioned sheet and which adheres thereto and, fourthly, of a second rigid plate covering the second layer of thermal insulation and with it constituting a primary insulating barrier element.

According to one embodiment, the tank comprises first lateral panels having the overall shape of a rectangular parallelepiped, the secondary insulating barrier element having, viewed in plan view, the shape of a first rectangle, the primary insulating barrier element having, viewed in plan view, the shape of a second rectangle, the two rectangles having their sides practically parallel, the length and width of the second rectangle being shorter respectively than the length and width of the first rectangle, a peripheral rim, preferably of constant width, thus being formed on each first lateral panel around the primary insulating barrier element of the said first lateral panels, the said first lateral panels being arranged in one or more row(s), their longitudinal axes parallel to an oblique solid angle of intersection, and second lateral panels having, in cross section, the shape of a rectangular trapezium, the secondary insulating barrier element having, viewed in plan view, the shape of a first rectangular trapezium and having a face which is oblique with respect to the longitudinal axis of the said second lateral panels, the primary insulating barrier element having, viewed in plan view, the shape of a second rectangular trapezium and having a face which is oblique with respect to the longitudinal axis of the said second lateral panels, the two rectangular trapeziums having their sides practically parallel, the length and width of the second rectangular trapezium being shorter respectively than the length and width of the first rectangular trapezium, a peripheral rim, preferably of constant width, thus being formed on each second lateral panel around the primary insulating barrier element, the said second lateral panels being arranged between the first lateral panels and the central panels, their longitudinal axes parallel to an oblique solid angle of intersection and their oblique faces parallel to the longitudinal faces of the central panels.

Advantageously, the peripheral regions that there are between the primary insulating barrier elements of two adjacent central panels, of two adjacent lateral panels or of an adjacent central panel and second lateral panel are filled, so as to ensure the continuity of the primary insulating barrier consisting of the central and lateral panels, using insulating tiles, each of which consists of a layer of thermal insulation covered by a rigid plate, each tile having the thickness of the primary insulating barrier, so that after assembly, the rigid plates of the insulating tiles form, with the second rigid plates of the lateral and central panels and the top faces of the rigid layers of the central panels, a practically continuous wall capable of supporting the primary watertightness barrier.

According to one particular feature, the central strakes are arranged in first longitudinal setbacks present on the rigid layer and the second rigid plate of each central panel, and on the rigid plates of the tiles forming the junction between two central panels, the flanges of the weld supports of each central panel being housed in transverse setbacks of the rigid layer so that the central strakes form, with the two rigid plates and the top faces of the rigid layers of the central panels, a practically continuous surface.

Advantageously, two longitudinal bands of thermal protection are arranged, under the central strakes, on each side of the plane of symmetry, in second longitudinal setbacks present on the rigid layer and the second rigid plate of each central panel, and on the rigid plate of the tiles forming the junction between two central panels, so as to thermally protect the underlying regions during the operation of welding the running strakes to the central strakes.

According to another particular feature, the longitudinal edges of the central strakes are screwed to the rigid layer, the second rigid plate of the central panels and the plate of the joining tiles by means of screws, the heads of which lie flush with the top surface of the central strakes and are covered by the ends of the running strakes, the oblique edges of the said ends being welded beyond the said screws.

Advantageously, the central strakes comprise holes obtained by punching so as to allow the fixing screws to pass and so as to accommodate the heads of the said screws in recesses, third setbacks present on the rigid layer and the second rigid plate of each central panel and the rigid plate of the tiles forming the junction between two central panels being designed to accommodate the material upset during the punching operation and corresponding to the said recesses.

According to one embodiment, the said rigid layer consists of at least one block of plates of bonded ply.

According to one particular feature, the weld support associated with the running metal strakes of the primary watertightness barrier is a section piece with a bracket-shaped cross section, one of the flanges of the bracket being welded to the turned-up edges of two adjacent metal strakes of the primary watertightness barrier, while the other flange is engaged in slots, parallel to an oblique solid angle of intersection, which are made in the thickness of the second rigid plate of first lateral panels parallel to their longitudinal axes, in the thickness of the second rigid plate of second lateral panels perpendicular to their longitudinal axes and in the thickness of the rigid plate of joining tiles filling the peripheral regions that there are between the primary insulating barrier elements of two adjacent lateral panels and between the primary insulating barrier elements of a central panel and of a second lateral panel.

Advantageously, the central panels and the first lateral panels consist of prefabricated panels, the second lateral panels consisting of prefabricated panels cut to size at the time of fitting of the secondary barriers and of the primary insulating barrier in the region of the variable-width wall.

According to one particular feature, the layers of thermal insulation of the secondary insulating barrier elements of the central panels consist of a compressible cellular plastic and may have, parallel to their large faces, a number of fibreglass fabrics forming practically parallel leaflets so that the tensile forces of the running strakes are reacted partly by the corner structures of the bearing structure to which corner structures the end central strake(s) is (are) fixed, and partly by the variable-width wall of the bearing structure to which the central panels are fixed, the distribution of these forces depending on the flexibility of the cellular plastic used.

In one embodiment, the tank is built into the front or rear part of a ship. In particular, the bearing structure comprises at least two mutually parallel trapezoidal longitudinal walls forming the bottom and the roof of the tank.

BRIEF DESCRIPTION OF THE DRAWINGS

The invention will be better understood and other objects, details, characteristics and advantages will become more clearly apparent in the course of the detailed explanatory description which will follow of one particular currently preferred embodiment of the invention, with reference to the appended schematic drawing.

In this drawing.

DESCRIPTION OF THE PREFERRED EMBODIMENTS

Figure 1:
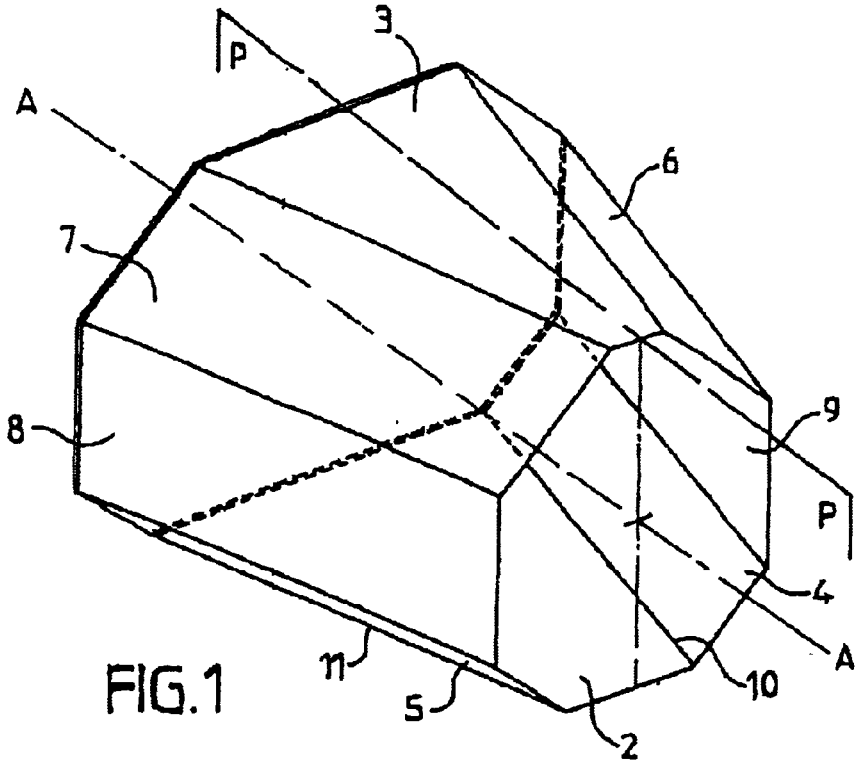
FIG. 1 depicts a schematic perspective view of a bearing structure of the bow part of a ship.
Figure 3:
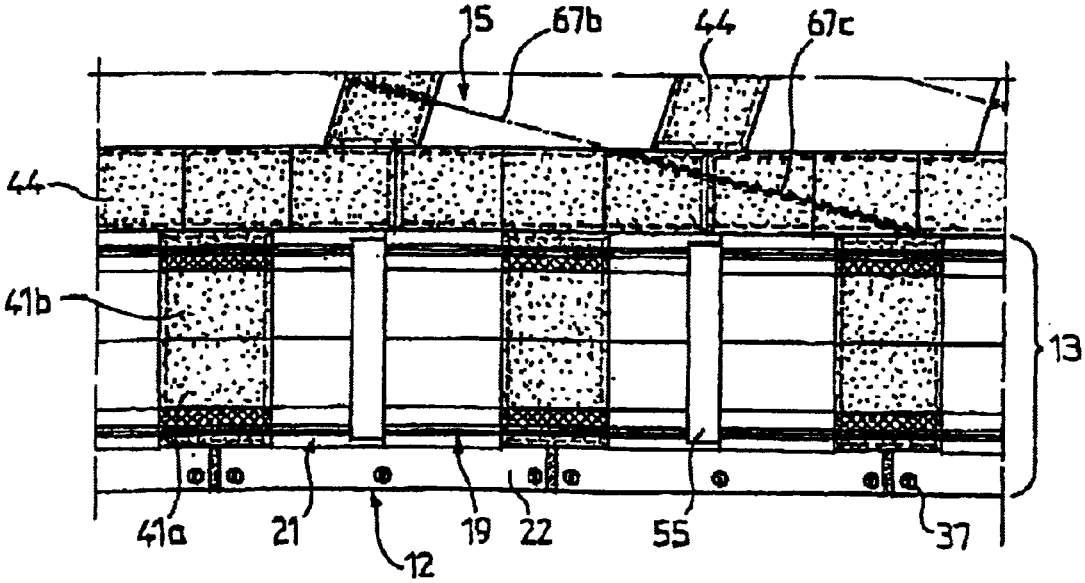
FIG. 3 depicts an enlarged part view of FIG. 2, after the joining tiles have been fitted.

FIG. 1 shows a compartment, i.e., a bearing structure 1, in the bow part of a ship, into which the tank according to the invention is intended to be built. The compartment has octagonal cross sections and is defined by eight longitudinal walls 2–9 of the double hull of the ship, these being practically flat, adjacent via their longitudinal edges, and two transverse partitions (not depicted), respectively rear and front, which are mutually parallel and are perpendicular to the longitudinal walls. The tank compartment comprises two longitudinal walls 2, 3 in the shape of an isosceles trapezium, forming the bottom and the roof of the tank. These two walls 2, 3, known as trapezoidal walls, are mutually parallel and have a common longitudinal plane of symmetry P passing through the longitudinal axis A of the compartment. These trapezoidal walls narrow from the rear towards the front of the ship. The other longitudinal walls 4–9, known as lateral walls, have a rectangular shape. Each trapezoidal wall 2, 3 defines, with an adjacent lateral wall, an oblique solid angle of intersection 10, 11. Two lateral walls 4, 5 of the same width are adjacent to the bottom wall 2, the other four lateral walls 6–9, two 6, 7 of which are adjacent to the roof wall, have identical widths, greater than the width of the previous two walls 4, 5. Thus, the trapezoidal wall 2 forming the bottom has a large base and a short base which are respectively longer than the long base and the short base of the trapezoidal wall 3 that forms the roof.

The two watertightness and insulating barriers at the lateral walls which, in plan view, have a rectangular shape, are produced, in the known way, by means of parallelepipedal prefabricated panels arranged longitudinally parallel to the solid angles of intersection defined by each pair of lateral walls and of running strakes as described in the aforementioned French Patent Application 2 724 623.

The production of the two watertightness and insulating barriers at the trapezoidal wall 2 forming the bottom, will now be described, those situated at the trapezoidal wall 3 forming the roof being produced in the same way.

Figure 2:
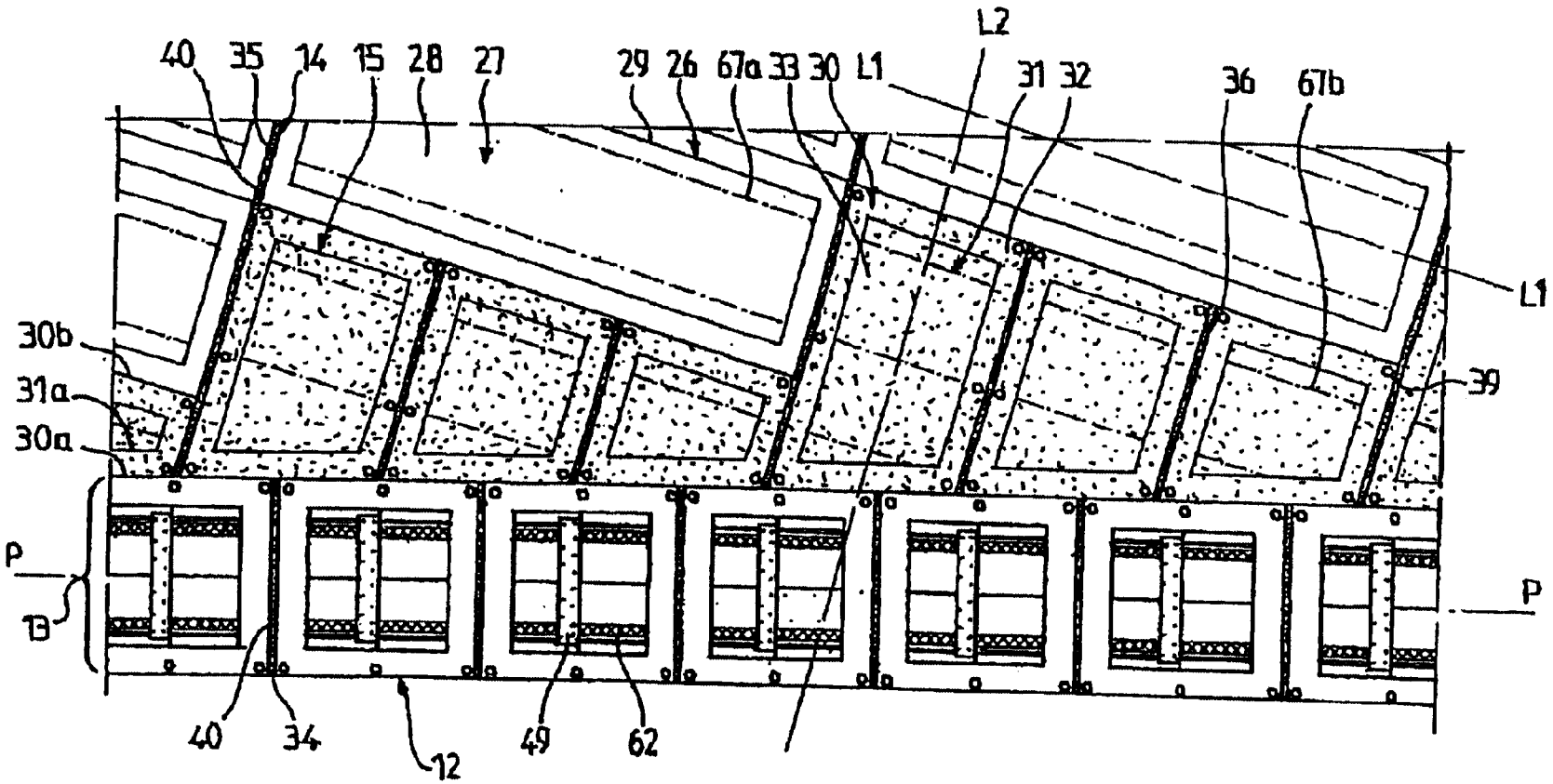
FIG. 2 depicts a part view from above of the central and lateral panels arranged on the trapezoidal wall forming the bottom of the bearing structure of FIG. 1, before the joining tiles and the lateral and central strakes are fitted.

With reference to FIG. 2, the two secondary barriers and the primary insulating barrier are produced, on the one hand, from central panels, denoted by 12 in their entirety, aligned to form a row 13 centered on the plane of symmetry P of the wall, and, on the other hand, from two types of lateral panels, denoted by 14 and 15 in their entirety, arranged on each side of the row of central panels.

According to FIGS. 4 to 7, each central panel 12 has practically the shape of a rectangular parallelepiped; it consists of a first plate 16 of ply surmounted by a first layer of thermal insulation 17, itself surmounted by a rigid sheet 18; arranged on the sheet 18 are, on the one hand, a second layer of thermal insulation 19 covered by a second plate of ply 20 and, on the other hand, a rigid layer 21. The subassembly 19, 20, 21 has, viewed in plan view, a rectangular shape, the sides of which are parallel to those of the subassembly 16, 17; the two subassemblies have, viewed in plan view, the shape of two rectangles having the same centre, there being a peripheral rim 22 of constant width all around the subassembly 19, 20, 21 consisting of the border of the second subassembly 16, 17. The subassembly 19, 20, 21, known as the first subassembly, constitutes a primary insulating barrier element and the subassembly 16, 17, known as the second subassembly, constitutes a secondary insulating barrier element. The sheet 18 which covers this first subassembly 16, 17 constitutes a secondary watertightness barrier element.

The central panel 12 which has just been described can be prefabricated to form an assembly, the various constituent parts of which are bonded together in the arrangement indicated hereinabove; this assembly therefore forms secondary barrier elements and primary insulating barrier elements.

Figure 8:
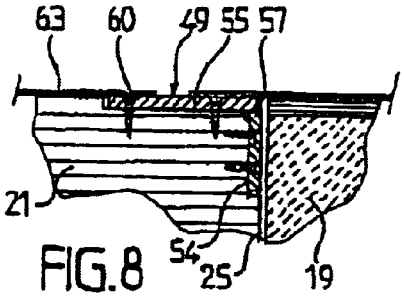
FIG. 8 depicts a part view in longitudinal section of the central panel of FIG. 5 on VIII—VIII illustrating the fixing of two adjacent central strakes to an angle bracket.
Figure 9:
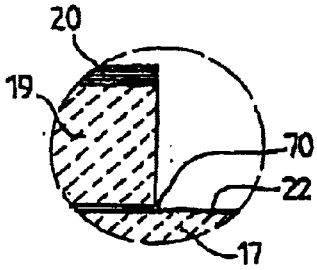
FIG. 9 depicts an enlarged part view of a detail of FIG. 6 delimited by box IX, showing the layout of a primary insulating barrier element on a secondary insulating element.
Figure 10:
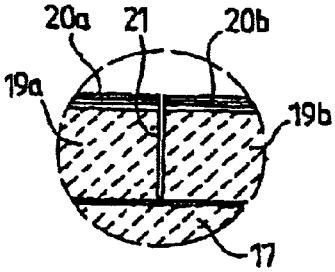
FIG. 10 depicts an enlarged part view of a detail of FIG. 7 delimited by box X, showing the relaxation gap between the two blocks of foam that make up the primary insulating element.

The rigid layer 21 consists for example of two paralellepipedal blocks 21*a*, 21*b* formed of bonded plates of ply, hereinafter known as ply blocks. These ply blocks are placed edge to edge in a transverse direction, leaving a relaxation gap 23 (FIG. 5) between them. The second layer 19 of thermal insulation is formed of two blocks 19*a*, 19*b* made of a cellular plastic, such as a polyurethane foam, which is given good mechanical properties by inserting fibreglass fabrics therein. Each block of foam, covered by a second plate of ply 20*a*, 20*b*, is of a size practically similar to that of a ply block 21*a*, 21*b*. The blocks of foam are juxtaposed edge to edge, each block of foam sitting against a ply block. Relaxation gaps 24, 25 are left respectively between the blocks of foam (FIG. 10) and between a block of foam and a ply block (FIG. 8). As depicted in FIG. 9, the blocks of foam have a peripheral rim 70. The first layer of thermal insulation 17 may consist of a cellular material identical to that of the second layer of thermal insulation. The rigid sheet 18, which is "sandwiched" between the primary and secondary insulating barrier elements, consists of a composite material made up of three layers: the two outer layers are fibreglass fabrics and the interlayer is a metal foil.

The central panels 12 are fixed side by side to the trapezoidal wall, leaving a joining region 34 which separates the second subassemblies of two adjacent central panels. The central panels form a row 13 centred on the plane P, in which row the blocks of foam and the ply blocks alternate in the longitudinal direction, the two ply blocks 21*a*, 21*b* of a panel being placed downstream of the two blocks of foam 19*a*, 19*b* of the same panel with respect to the front transverse partition of the compartment.

Arranged on either side of this row 13 or alignment of central panels are first lateral panels 14 and second lateral panels 15. The first lateral panels, known as standard panels, consist of prefabricated panels such as those described in the aforementioned French Patent Application. With reference to FIG. 2, each standard panel 14 is practically in the shape of a rectangular paralellepiped; it consists of a first subassembly 26 formed of a first plate of ply surmounted by a first layer of thermal insulation, a flexible or rigid sheet and a second subassembly 27 formed of a second layer of thermal insulation covered by a second plate 28 of ply, the second layer being arranged on the aforementioned sheet. The second subassembly 27 constitutes a primary insulating barrier element and, viewed in plan view, has a rectangular shape, the sides of which are parallel to those of the subassembly; the two subassemblies have, viewed in plan view, the shape of two rectangles having the same centre, there being a peripheral rim 29 of constant width all around the second subassembly consisting of the border of the first subassembly. The first subassembly 26 constitutes a secondary insulating barrier element and the sheet covering the first subassembly constitutes a secondary watertightness barrier element.

These standard panels 14 differ from the central panels 12 in that they have no rigid layer 21. The primary insulating barrier elements consist solely of a second layer of insulation made of foam, covered by a plate of ply. Furthermore, the sheet between the primary and secondary insulating barrier elements may be a flexible sheet consisting of a composite material made up of three layers: the two outer layers are fibreglass fabrics and the interlayer is a thin metal foil, for example an aluminium foil approximately 0.1 mm thick. This metal foil constitutes the secondary watertightness barrier and is bonded to the layer of thermal insulation. The layers of thermal insulation of these standard panels 14 may consist of a cellular material identical to the one used to form the central panels.

These standard panels 14 are arranged in several rows and have their longitudinal axes L1 parallel to the oblique solid angles of intersection 10, 11. By way of example, the oblique solid angles of intersection make an angle of the order of 15–16° with the plane P. To produce each row, the standard panels are arranged one after the other starting near the rear transverse partition and the row ends when the space remaining near the row 13 of central panels is not large enough to allow a full standard panel to be fitted. Two adjacent standard panels of one and the same row have their first subassemblies spaced apart by a joining region 35, and two adjacent panels of two different rows have their first subassemblies edge to edge. The standard panels at the oblique solid angles of intersection will of course be mitred at an angle suited to that formed by the trapezoidal wall and the adjacent lateral wall at this oblique solid angle of intersection.

Second lateral panels known as special panels 15 are inserted between the row 13 of central panels 12 and the standard panels 14 which are at the end of each row of standard panels, so as to ensure the continuity of the two secondary barriers and of the primary insulating barrier between these. These special panels 15 are of a structure similar to that of the standard panels, comprising a first subassembly 30 and a second subassembly 31, but having the shape of a rectangular trapezium in cross section, and are arranged side by side, leaving a joining region 36 between two adjacent second subassemblies, with their longitudinal axes L2 perpendicular to the oblique solid angles of intersection. The two subassemblies 30, 31 of each special panel 15 have, viewed in plan view, the shape of two rectangular trapeziums having the same centre and parallel sides, there being a peripheral rim 32 of constant width all around the second subassembly 31, this consisting of the border of the first subassembly 30. Each rectangular trapezium has a side which is oblique with respect to the longitudinal axis L2, corresponding to a face known as the oblique face 30*a*, 31*a*, of the first subassembly and of the second subassembly. The oblique faces 30*a* of the first subassemblies of the special panels sit against the longitudinal faces of the first subassemblies 16, 17 of the central panels 12 and their transverse faces 30*b* opposite their oblique faces and perpendicular to their longitudinal axes L2 sit against the longitudinal faces of the standard panels 14.

These special panels 15 may be produced from prefabricated panels similar to those that make up the standard panels but cut to size at their time of installation. Furthermore, the width and length of these prefabricated panels used to produce the special panels will be tailored to suit those of the standard panels, so as to obtain a juxtaposition which is simple to install. As illustrated in FIG. 2, the length of a standard panel is practically equal to three times the width of a special panel plus two joining regions 36 separating the special panels.

Figure 11:
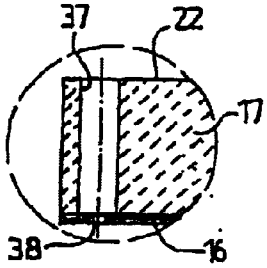
FIG. 11 depicts an enlarged part view of a detail of FIG. 6 delimited by box XI, illustrating a fixing well.

In a known way, to fix the central panels to the trapezoidal wall, there are provided, distributed uniformly along the entire perimeter of the central panels, wells 37 which are cylindrical recesses made in the peripheral rims 22 through the sheet 18 and the layer of insulation 17 down to the plate of ply 16, as visible in FIG. 11; the bottom of a well therefore consists of the first rigid plate 16 of the central panel; the bottom of the well is perforated to form an orifice 38. The trapezoidal wall carries studs which are welded at right angles to it and the free ends of which are threaded. The studs and the orifices 38, which are large enough in diameter to allow a stud to pass, are arranged in such a way that if a central panel is offered up opposite the trapezoidal wall, the said panel can be positioned with respect to the wall in such a way that a stud faces each orifice.

It is known that the walls of a ship deviate from the theoretical surface intended for the bearing structure simply as a result of manufacturing imprecisions. In the known way, these deviations are compensated for by resting the central panels up against the bearing structure via wads of curable resin which, starting from an imperfect surface of bearing structure, make it possible to obtain cladding consisting of adjacent elements exhibiting second plates and ply panels which, in their entirety, define a surface which exhibits practically no deviation from the desired theoretical surface. When the central panels 12 are offered up in this way against the bearing structure with wads of resin interposed, the studs enter the orifices 38 and a bearing washer and a tightening nut are placed over the threaded end of the studs. The washer is pressed by the nut against the first rigid plate 16 of the panel 12 at the bottom of the well 37. Thus, each panel 12 is fixed against the trapezoidal wall by a number of points distributed over the entire periphery of the panel, which is good from a mechanical standpoint.

The lateral panels 14, 15 are fixed in the same way via studs present on the trapezoidal wall and wells 39 present on their peripheral rims 29, 32.

When such fixing has been performed in the known way, the wells in the panels 12, 14, 15 are plugged by inserting plugs of thermal insulation therein, these plugs lying flush with the first layer of thermal insulation of the various panels. Furthermore, a thermal insulation material forming a joint 40 and consisting, for example, of glass wool with a density of 22 kg/m$^3$ is fitted into the joining regions 34 which separate the first subassemblies of two adjacent central panels, and the joining regions 35, 36, perpendicular to the oblique solid angles of intersection, of two first subassemblies of two standard and/or special elements.

Nevertheless, while the continuity of the secondary insulating barrier has been reconstructed in this way, the same is not true of the continuity of the secondary watertightness barrier formed by the sheets covering the first subassemblies of the various panels, because this barrier has been perforated at each well 37, 39. To reconstruct the continuity of the secondary watertightness barrier, a band (not visible), formed of a flexible sheet, for example identical to the flexible sheet of the lateral panels, is fitted on the peripheral rims 22, 29, 32 that there are between two first subassemblies of two adjacent panels and the band is bonded to the peripheral rims in such a way as to close off the perforations in line with each well 37, 39 and the joins 40 between the panels, and this may reconstitute the continuity of the secondary watertightness barrier.

As illustrated in FIG. 2, between the subassemblies of two adjacent panels 5 there then remains a set back region situated in line with the peripheral rims 22, 29, 32, this set back region having practically, by way of depth, the thickness of the primary insulating barrier. The set back regions between two central panels are filled by installing insulating tiles 41*a*, 41*b*, for example two of these, each consisting of a layer of thermal insulation 42 and of a rigid plate of ply 43. Likewise, the set back regions between the lateral panels 14, 15 and between the standard panels and the special panels are filled with tiles 44 also consisting of a layer of thermal insulation 45 and of a plate of ply 46. The insulating tiles 41*a*, 41*b*, 44 have a dimension such that they completely fill the region situated above the peripheral rims of two adjacent panels, these insulating tiles being bonded to the aforementioned bands so that, once they have been installed, their plates 43, 46 form, with the second rigid plates of the lateral and central panels and the top faces of the ply blocks 21*a*, 21*b* of the central panels, a practically continuous surface capable of supporting the primary watertightness barrier.

Figure 13:
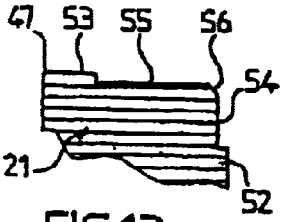
FIG. 13 depicts a part view in longitudinal section of the central panel of FIG. 5 on XIII—XIII illustrating the setbacks intended for fixing the angle bracket.
Figure 15:
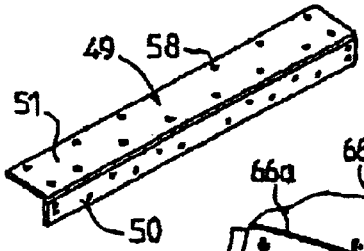
FIG. 15 is a perspective view of an angle bracket.

There then remains for the primary watertightness barrier to be fitted, which will be assembled on this practically continuous surface. To do this, there is provided, at the time of manufacture of the central panels 12, a first longitudinal setback 47 extending on the entire length of the top faces 53 of the ply blocks 21*a*, 21*b*, of the rigid plates 43, 20 covering the second insulating layer 19 of foam, and the tiles 41*a*, 41*b* forming the junction between two adjacent central panels 12 and over most of the width of these, forming two rims 48 which are symmetric with respect to the plane of symmetry P. A weld support 49 is fixed to the transverse upper solid angle of intersection of the ply blocks of each central panel, positioned on the side of the blocks of foam. As illustrated in FIG. 15, the weld support 49 is formed of a section piece in the shape of a L or angle bracket, consisting of two stainless steel or Invar, preferably Invar, flanges 50, 51 welded at right angles to each other. According to FIGS. 8 and 13, a first flange 50 is fixed against the lateral faces 52 of the ply blocks facing the second layer 19 of insulation of the panel, and the second flange 51 is fixed against the top face 53 of the ply blocks. The top face 53 and the transverse face 52 mentioned above each have a transverse setback 54, 55 in which one of the flanges is housed so that the first flange 50 via its top face forms a continuous surface with the bottom of the first longitudinal setback 47. Furthermore, a chamfer 56 is formed at the said solid angle of intersection so as to leave a large enough space to accommodate the weld 57 that joins the two flanges of the angle bracket together. The angle bracket is fixed by screws 60, screwed into the ply blocks. The flanges have a collection of holes 58, uniformly distributed, for the passage of the screws, each hole having a conical flared portion which houses the screw head. In this embodiment, the angle bracket housed in the transverse setbacks runs transversely and beyond the first setback 47.

Figure 12:
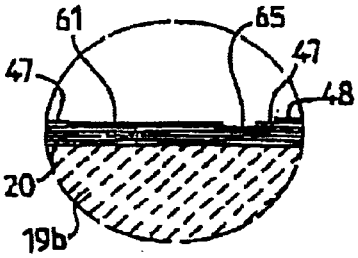
FIG. 12 depicts an enlarged part view of a detail of FIG. 7 delimited by box XII showing various setbacks on the second rigid plate.
Figure 14:
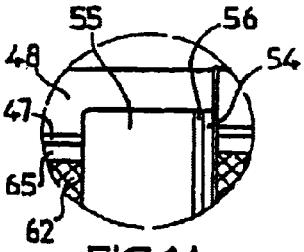
FIG. 14 depicts an enlarged part view of a detail of FIG. 7 delimited by box XIV showing the various setbacks on a block of ply.

According to FIG. 12, two second longitudinal setbacks 61 are provided in the first setbacks 47. These second setbacks are arranged symmetrically with respect to the plane of symmetry P, some distance from the rims 48 formed by the first setbacks. Housed in these second setbacks are thermal protection bands 62 intended to protect the underlying elements when the running strakes are welded, as described hereinafter. As visible in FIG. 14, these bands 62 do not cover the transverse setbacks 55.

Figure 5:
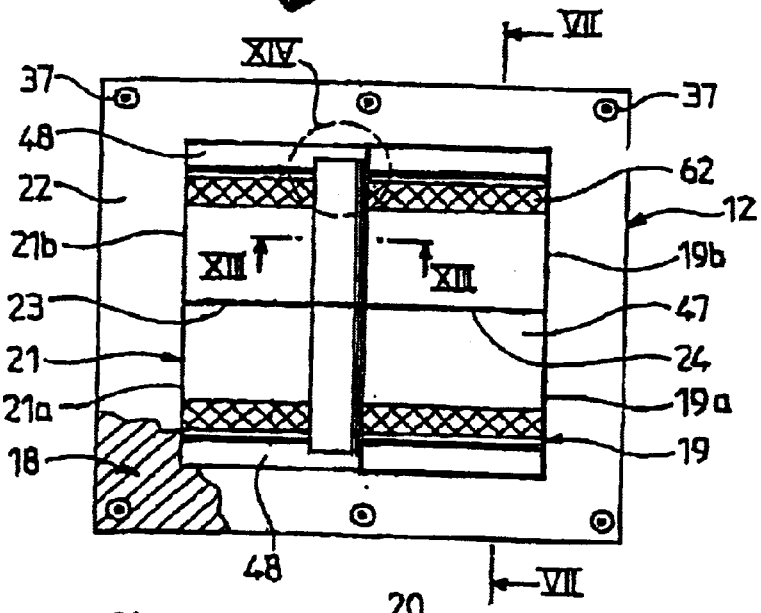
FIG. 5 is a view from above of a central panel.
Figure 6:
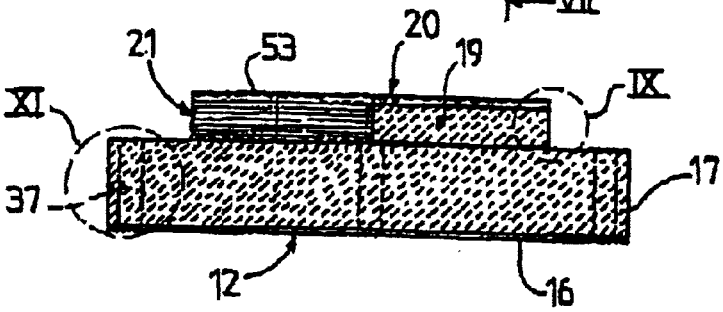
FIG. 6 is a side view of the central panel of FIG. 5.
Figure 7:
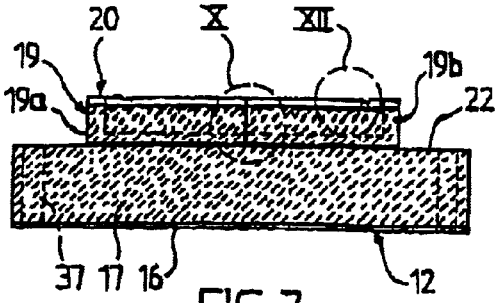
FIG. 7 depicts a view in cross section of the central panel of FIG. 5 on VII—VII.

As visible in FIG. 5, these bands 62 do not cover the transverse setbacks 35.

Figure 4:
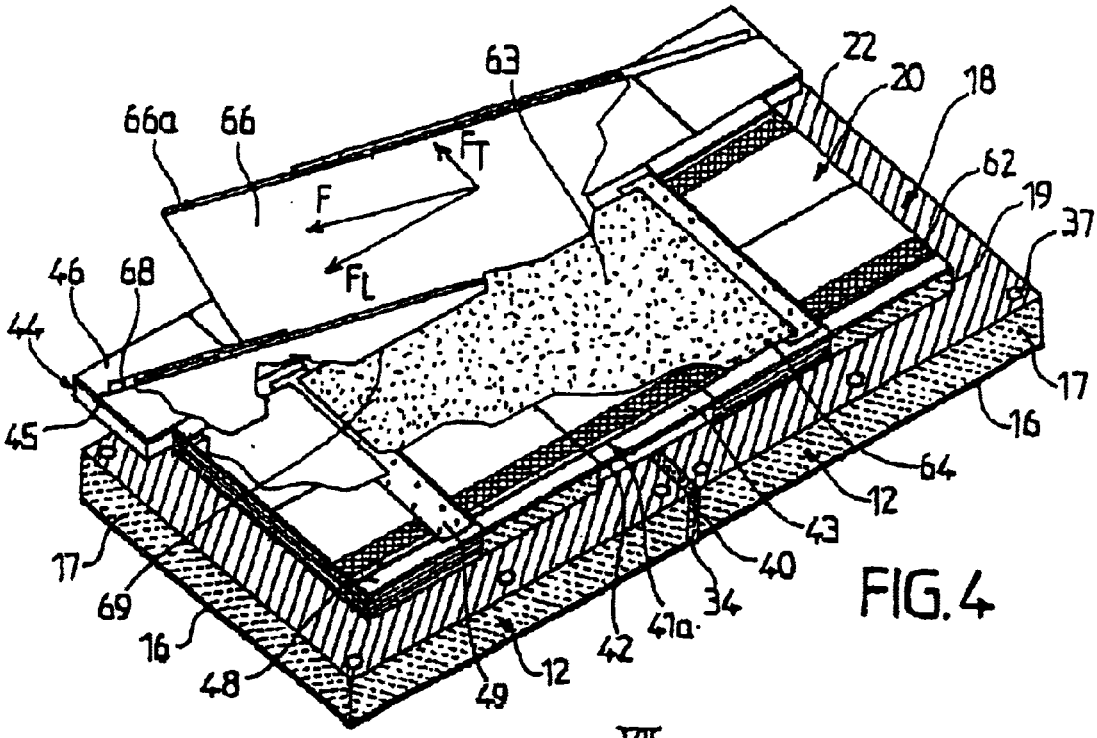
FIG. 4 depicts a perspective part view of two central panels illustrating the structure of the central panels and the assembly of the lateral and central strakes.

According to FIG. 4, central strakes 63 made of rectangular Invar plate with a thickness of the order of 1.5 mm are fixed to the angle brackets 49, by welding the transverse edges of each strake to the angle brackets 49 of two adjacent central panels. The strakes are entirely housed in the first longitudinal setback 47 which means that their upper face which faces the inside of the tank lies flush with the face of the rims 48. The central strake known as the end strake, arranged at the front end of the row 13, is fixed by one of its transverse edges to the angle bracket of the last central panel of the row 13 and is fixed by its other transverse edge to a rigid corner structure fixed to the bearing structure at the solid angle of intersection formed by the trapezoidal wall and the front transverse partition. The corner structure used may be of the type described in French Patents 2 709 725 and 2 780 942. The longitudinal edges of the central strakes 63 are also screwed to the panels and the underlying blocks via screws 64 passing through uniformly spaced holes in each strake. The holes for the passage of the screws are made by punching, so as to form recesses able to accommodate the heads of the screws 64 so that these heads do not protrude. Two third longitudinal setbacks 65, arranged symmetrically with respect to the plane P are provided in the second longitudinal setbacks 61 so as to house the material upset by the punching of the holes and corresponding to the aforementioned recesses. The screws 64 are arranged beyond the protective bands 62 with respect to the plane P, each third setback 65 running transversely between a protective band and the outer longitudinal edge of the second setback in which the band is placed.

Figure 16:
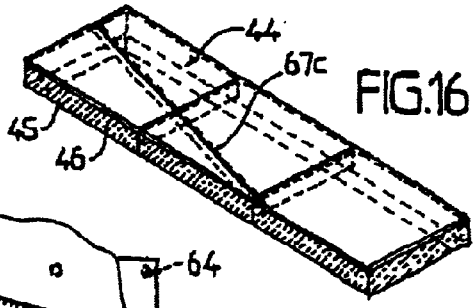
FIG. 16 is a perspective view of three joining tiles intended to be arranged between the central panels and the lateral panels showing the position of a T-shaped slot; and, FIG. 17 is an enlarged part view of FIG. 4 showing the ends of two adjacent lateral running strakes welded to a central strake.

The special panels comprise slots 67*b* of identical shape to that of the standard panels but arranged at right angles to their longitudinal axes L2. These slots are spaced apart by a distance equal to the spacing between the slots 67*a* of the standard panels and are arranged in the continuation of the slots 67*a* of the standard panels. Likewise, the slots 67*c* are provided on the plates 46 of certain tiles 44 for joining the lateral panels and the central panels and the special lateral elements. FIG. 16 depicts an example of a slot 67*c* running along the tiles that form the junction between the special panels and the central panels.

Placed in these slots 67*a–c* is a weld support 68 consisting, in the known way, of a section piece having a bracket-shaped cross section, one of the flanges of the bracket being welded to the turned-up edges 66*a* of two adjacent running strakes, while the other flange is engaged in the part of the slot which is parallel to the mean plane of the plates 28, 33, 46. In the known way, the strakes consist of Invar plates, for example 1 mm thick. The weld support can slide inside the slot which means that a sliding joint is thus produced which allows relative displacement of the running strakes with respect to the rigid plates 28, 33, 46 which support them.

Each plate of a standard panel 14 comprises two parallel slots 67*a* spaced apart by the width of a running strake and arranged symmetrically with respect to the longitudinal axis L1 of the panel. The panels are sized in such a way that the distance between two adjacent weld flanges fitted in two adjacent panels is equal to the width of a strake; it is thus possible to position a strake in line with the central region of each plate and a strake between the two strakes, which cover the central regions of two adjacent panels.

Figure 17:
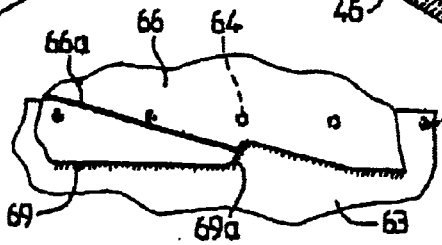

The ends of the running strakes 66, thus mounted to slide parallel to the oblique solid angles of intersection, are cut off to exhibit an oblique edge 69, parallel to the plane of symmetry P. The running strakes partially cover the central strakes 63 which means that their oblique edges 69 are arranged beyond the screws 64 that fix the central strakes, and the oblique edges 69 are welded to the top face of the central strakes which faces towards the inside of the tank, along a weld line parallel to the plane P. The turned-up edges 66*a* of two adjacent lateral running strakes are welded directly to one another at the end parts of the running strakes which extend beyond the joining tiles 44 and which partially cover the central strakes and all of the rim 48. According to the embodiment of FIG. 17, the oblique edges 69 of two adjacent running strakes 66 are cut in the region where their adjacent longitudinal turned-up edges 66*a* meet the oblique edges 69 so that the weld line in this region has the shape of a saw-tooth, of which a part 69*a* is practically perpendicular to the turned-up edges 66*a* of the adjacent strakes.

During this welding operation, the bands 62 arranged under the central strakes afford thermal protection to the various underlying elements. The running strakes 66 covering the rims 48 and the fixing screws 64 ensure the continuity of the primary barrier. The second flange 51 of the Invar angle bracket also makes it possible to ensure the continuity of the primary watertightness barrier between the transverse edges of two adjacent central strakes.

The behaviour of the primary watertightness barrier at the trapezoidal wall upon the filling of the tank will now be described with reference to FIG. 4. The various elements described hereinabove and that make up the wall of the tank according to the invention are mounted on the bearing structure empty, at an ambient temperature generally of between 5 and 25° C. and at atmospheric pressure. When the tank is filled with liquid methane at a temperature of about −160° C., the running strakes, although they have a very low coefficient of contraction, contract tangibly upon contact with the liquefied gas. Because the running strakes are fitted without being fixed to the surface of the lateral panels, the longitudinal thermal tensile forces F in each running strake are transmitted to the central strakes 63 to which they are welded. The central strakes, fixed to the central panels, allow part of the longitudinal component $F_L$ of these forces to be taken up by the trapezoidal wall to which the central panels are fixed. Furthermore, given that the layers of insulation of the central panels are compressible, part of this longitudinal component is transmitted to the front partition of the compartment to which the central strake at the end of the row is fixed by a rigid corner structure. The distribution of the reaction of the longitudinal component $F_L$ of these forces between the trapezoidal wall and the front transverse partition can be adjusted according to the flexibility of the cellular material used to make the insulating layers.

As the running strakes are arranged symmetrically with respect to the plane of symmetry P, the transverse components $F_T$ of the said tensile forces completely or to a large extent cancel each other out.

It should be noted that each central strake is fixed to two angle brackets, each fixed to a rigid layer of a central panel, which ensures a strong securing of the central strakes and good distribution of tensile forces on the bearing structure. Furthermore, a more rigid structure is generally provided along the axis of the ship, particularly for putting the ship into dock or onto a slipway when it rests on its keel. The ships for this purpose have a reinforced central part between the double hull and the hull which cannot be "ballasted". As the row of central panels is arranged along the axis of the ship, the aforementioned tensile forces are advantageously taken up by this reinforced central part.

Furthermore, as the running strakes of the trapezoidal wall according to the invention are arranged parallel to the oblique solid angles of intersection, it is then possible, at the solid angles of intersection, to provide a row of corner strakes which have several undulations and which are fixed to a corner structure, such as those described in French Patent Application No. 00 10704 filed on Aug. 18, 2000 by the Applicant company and now published as US 2002/0023926A1.

Although the invention has been described in conjunction with one particular embodiment, it is obvious that it is not in any way restricted thereto and that it comprises all technical equivalents of the means described together with combinations thereof where these fall within the scope of the invention.

What is claimed is:

1. Watertight and thermally insulating tank built into a bearing structure (1), the bearing structure being of polygonal cross section and comprising a number of practically flat rigid walls (2–9) adjacent by their longitudinal edges, at least one of the walls (2, 3) having a width that varies over at least part of the length of the wall, solid angles of intersection (10, 11) of the bearing structure which are formed by the variable-width wall and the adjacent walls being orientated obliquely, the tank comprising two successive watertightness barriers, one of them a primary watertightness barrier in contact with the product contained in the tank and the other a secondary watertightness barrier arranged between the primary watertightness barrier and the bearing structure, a primary thermally insulating barrier being arranged between these two watertightness barriers and a secondary thermally insulating barrier being arranged between the secondary watertightness barrier and the bearing structure, the secondary insulating and watertightness barriers and the primary insulating barrier being essentially formed of a collection of juxtaposed panels fixed to the walls of the bearing structure over practically its entire interior surface, the panels being able to support and to hold the primary watertightness barrier, the primary watertightness barrier comprising practically flat running metal strakes, made of thin plate with a low coefficient of expansion, the longitudinal edges of which are turned up towards the inside of the tank, each running strake being assembled in a watertight manner with at least one longitudinally adjacent running strake, the adjacent turned-up edges of the running strakes being welded to two faces of a weld support, which is held mechanically on panels and constitutes a sliding joint, characterized in that the primary watertightness barrier further comprises, at each variable-width wall (2, 3), one or more practically flat central strake(s) (63) made of thin plate with a low coefficient of expansion, which is (are) arranged longitudinally and each of which is fixed to underlying panels (12), running strakes (66) being held, parallel to the oblique solid angles of intersection (10, 11) of the variable-width wall (2, 3), on underlying panels and fixed in a watertight manner at the ends to the central strake(s), so that the tensile forces (F) experienced by the running strakes in their longitudinal dimension, generated by the thermal contraction and/or the static or dynamic pressure of the product contained in the tank, are transmitted at least in part to the bearing structure via the central strake(s).

2. Tank according to claim 1, characterized in that the variable-width wall (2, 3) has a plane of symmetry (P) passing through the longitudinal axis of the wall and perpendicular to a flat surface of the wall.

3. Tank according to claim 2, characterized in that the variable-width wall (2, 3) has a width which varies monotonously along the entire length of the wall.

4. Tank according to claim 3, characterized in that one or more end central strake(s) (63) is (are) fixed to the bearing structure (1) by rigid corner structures.

5. Tank according to claims 2, characterized in that the panels comprise central panels (12) juxtaposed longitudinally along the plane of symmetry (P) of the variable-width wall, forming at least one row (13), to which the central strake(s) (63) are fixed, so that transverse components (VT) of the tensile forces experienced by the running strakes in their longitudinal dimension at least partially cancel each other out, and lateral panels (14, 15) arranged on each side of the central panels (12) on which running strakes (66) are held.

6. Tank according to claim 5, characterized in that it comprises several central strakes (63), adjacent transverse edges of the central strakes being welded to weld supports (49) which are held mechanically on the central panels (12), the central panels (12) are formed, firstly, of a first rigid plate (16) carrying a layer (17) of thermal insulation and with it constituting a secondary insulating barrier element, secondly, of a sheet (18) adhering to practically the entire area of the layer (17) of thermal insulation of the aforementioned secondary insulating barrier element, the sheet (18) comprising at least one continuous metal foil forming a secondary watertightness barrier element, thirdly, of a second layer (19) of thermal insulation covered by a second rigid plate (20) and by a rigid layer which are juxtaposed, the rigid layer and the second layer of thermal insulation which at least partially cover the aforementioned sheet (18) and which adhere thereto constituting a primary insulating barrier element, the central panels being arranged in such a way that the second layers of thermal insulation and the rigid layers alternate longitudinally, the central strake(s) (63) being at least fixed to the rigid layers (21) of the central panels.

7. Tank according to claim 6, characterized in that a weld support (49) welded to two adjacent central metal strakes (63) is held mechanically on the rigid layer (21) of one of the a central panels (12) and is a section piece with a bracket-shaped cross section, the bracket having flanges (50), one of the flanges (50) of the bracket being fixed against a the lateral face (52) of the rigid layer facing the second layer of insulation 19 of the central panel, while another flange (51) is fixed by one of its faces against a top face (53) of a formed solid layer and welded by its other face to the adjacent transverse edges of the two central strakes.

8. Tank according to claim 6, characterized in that each central panel (12) has the overall shape of a rectangular parallelepiped, the secondary insulating barrier element (16, 17) and the primary insulating barrier element (19, 20, 21) having, respectively, viewed in plan view, the shape of a first rectangle and of a second rectangle, the sides of which are practically parallel, the length and/or width of the first rectangle being shorter than that (those) of the second rectangle so as to form a peripheral lateral rim (22).

9. Tank according to claim 6, characterized in that the rigid layer (21) consists of at least one block (21*a*, 21*b*) of plates of bonded ply.

10. Tank according to claim 6, characterized in that the weld support (68) welded to the running metal strakes (66) of the primary watertightness barrier is a section piece with a bracket-shaped cross section, the bracket having flanges, one of the flanges of the bracket being welded to the turned-up edges (66*a*) of two adjacent metal strakes of the primary watertightness barrier, while another flange is engaged in slots (67*a*–*c*), parallel to an oblique solid angle of intersection (11, 12), which are made in the thickness of the second rigid plate (28) of first lateral panels (14) parallel to their longitudinal axes (L1), in the thickness of the second rigid plate (33) of second lateral panels (15) perpendicular to their longitudinal axes (L2) and in the thickness of the rigid plate (42, 46) of joining tiles (41*a*, 41*b*, 44) filling the peripheral regions that there are between the primary insulating barrier elements of two adjacent lateral panels (14, 15) and between the primary insulating barrier elements of a central panel (12) and of a second lateral panel (15).

11. Tank according to claim 6, characterized in that the layers (17) of thermal insulation of the secondary insulating barrier elements of the central panels (12) consist of a compressible cellular plastic having large faces and have, parallel to the large faces, a number of fibreglass fabrics forming practically parallel leaflets so that the tensile forces (F) of the running strakes are reacted partly by the corner structures of the bearing structure to which corner structures the end central strake(s) is (are) fixed, and partly by the variable-width wall (2, 3) of the bearing structure to which the central panels are fixed, the distribution of these forces depending on the flexibility of the cellular plastic used.

12. Tank according to claim 5, characterized in that the lateral panels (14, 15) are formed, firstly, of a first rigid plate carrying a layer of thermal insulation and with it constituting a secondary insulating barrier element (26, 30), secondly, of a flexible sheet adhering to practically the entire surface of the layer of thermal insulation of the secondary insulating barrier element, the sheet comprising at least one continuous thin metal foil forming a secondary watertightness barrier element, thirdly, of a second layer of thermal insulation which at least partially covers the flexible sheet and which adheres thereto and, fourthly, of a second rigid plate (28, 33) covering the second layer of thermal insulation and with it constituting a primary insulating barrier element (27, 31), the tank comprises first lateral panels (14) having the overall shape of a rectangular parallelepiped, the secondary insulating barrier element (26) having, viewed in plan view, the shape of a first rectangle, the primary insulating barrier element (27) having, viewed in plan view, the shape of a second rectangle, the two rectangles having their sides practically parallel, the length and width of the second rectangle being shorter respectively than the length and width of the first rectangle, a peripheral rim (29), preferably of constant width, thus being formed on each first lateral panel (14) around the primary insulating barrier element of the first lateral panels, the first lateral panels being arranged in one or more row(s), their longitudinal axes (L1) parallel to an oblique solid angle of intersection (10, 11), and second lateral panels having, in cross section, the shape of a rectangular trapezium, the secondary insulating barrier element (30) having, viewed in plan view, the shape of a first rectangular trapezium and having a face (30*a*) which is oblique with respect to the longitudinal axis (L2) of the second lateral panels, the primary insulating barrier element (31) having, viewed in plan view, the shape of a second rectangular trapezium and having a face (31*a*) which is oblique with respect to the longitudinal axis (L2) of the second lateral panels, the two rectangular trapeziums having their sides practically parallel, the length and width of the second rectangular trapezium being shorter respectively than the length and width of the first rectangular trapezium, a peripheral rim (32), preferably of constant width, thus being formed on each second lateral panel (15) around the primary insulating barrier element, the second lateral panels being arranged between the first lateral panels (14) and the central panels (12), their longitudinal axes (L2) parallel to an oblique solid angle of intersection and their oblique faces (30*a*, 31*a*) parallel to the longitudinal faces of the central panels.

13. Tank according to claim 12, characterized in that the peripheral regions that there are between the primary insulating barrier elements of two adjacent central panels (12), of two adjacent lateral panels (14, 15) or of an adjacent central panel and second lateral panel (15) are filled, so as to ensure the continuity of the primary insulating barrier consisting of the central and lateral panels, using insulating tiles (41*a*, 41*b*, 44), each of which consists of a layer (42, 45) of thermal insulation covered by a rigid plate (43, 46), each tile having the thickness of the primary insulating barrier, so that after assembly, the rigid plates of the insulating tiles form, with the second rigid plates (19, 28, 33) of the lateral and central panels and the top faces (53) of the rigid layers (21) of the central panels, a practically continuous wall capable of supporting the primary watertightness barrier.

14. Tank according to claim 13, characterized in that the central strakes (63) are arranged in first longitudinal setbacks (47) present on the rigid layer (21) and the second rigid plate (19) of each central panel (12), and on the rigid plates (43) of the tiles (41*a*, 41*b*) forming the junction between two central panels, the flanges (50, 51) of the weld supports (49) of each central panel being housed in transverse setbacks (54, 55) of the rigid layer so that the central strakes form, with the two rigid plates (19) and the top faces (53) of the rigid layers of the central panels, a practically continuous surface.

15. Tank according to claim 14, characterized in that two longitudinal bands (62) of thermal protection are arranged, under the central strakes (63), on each side of the plane of symmetry (P), in second longitudinal setbacks (61) present on the rigid layer (21) and the second rigid plate (19) of each central panel (12), and on the rigid plate (43) of the tiles (41*a*, 41*b*) forming the junction between two central panels, so as to thermally protect the underlying regions during the operation of welding the running strakes (66) to the central strakes.

16. Tank according to claim 14, characterized in that the longitudinal edges of the central strakes (63) are screwed to the rigid layer (21), the second rigid plate (19) of the central panels and the plate (43) of the joining tiles (41*a*, 41*b*) by means of screws (64), the heads of which lie flush with the top surface of the central strakes and are covered by the ends of the running strakes (66), the oblique edges of the ends being welded beyond the screws.

17. Tank according to claim 16, characterized in that the central strakes (63) comprise holes obtained by punching so as to allow the fixing screws (64) to pass and so as to accommodate the heads of the said screws in recesses, third setbacks (65) present on the rigid layer (21) and the second rigid plate (19) of each central panel and the rigid plate (43) of the tiles (41*a*, 41*b*) forming the junction between two central panels being designed to accommodate the material upset during the punching operation and corresponding to the recesses.

18. Tank according to claim 1, characterized in that ends of the running strakes (66) partially cover the central strake (s) (63) and have an oblique edge (69) practically parallel to a plane of symmetry (P), along which they are welded to the central strake(s) (63).

19. Tank according to claim 1, characterized in that it is built into the front or rear part of a ship.

* * * * *